US006371729B1

(12) United States Patent
Tseng

(10) Patent No.: US 6,371,729 B1
(45) Date of Patent: Apr. 16, 2002

(54) ASSEMBLING STRUCTURE FOR VANE AND VANE BRACKET OF CEILING FAN

(76) Inventor: Tien Fu Tseng, No.18, Chen Hsing Tung Street, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 09/729,236

(22) Filed: Dec. 5, 2000

(51) Int. Cl.[7] ..... F04D 29/34
(52) U.S. Cl. ..... 416/210 R; 416/244 R
(58) Field of Search ..... 411/5, 210 R, 411/244 R

(56) References Cited

U.S. PATENT DOCUMENTS 5,593,283 A * 1/1997 Scott ..... 416/244 R
6,010,306 A * 1/2000 Buchner et al. ..... 416/210 R

* cited by examiner

*Primary Examiner*—Edward K. Look
*Assistant Examiner*—Ninh Nguyen
(74) *Attorney, Agent, or Firm*—Rosenberg, Klein & Lee

(57) ABSTRACT

An Assembling structure for vane and vane bracket of ceiling fan, including a vane bracket and a vane. The vane bracket has several bosses and at least one projecting post. A resilient press board is pivotally disposed on top face of the projecting post. An end of the press board distal from the projecting post has a downward extending press section. The vane is formed with dents complementary to the bosses of the vane bracket. The vane is further formed with a slot corresponding to the projecting post of the vane bracket. The press board is passed through the slot. The vane is formed with a locating section in which the press section of the press board is located. When connecting the vane bracket with the vane, the press board is rotated to make the press section of the press board resiliently pressed against and located in the locating section of the vane by means of the resilient force of the press board so as to quickly and conveniently fixedly connect the vane bracket with the vane.

3 Claims, 8 Drawing Sheets

ASSEMBLING STRUCTURE FOR VANE AND VANE BRACKET OF CEILING FAN

BACKGROUND OF THE INVENTION

The present invention is related to an assembling structure for vane and vane bracket of ceiling fan, which enables a user to quickly and conveniently assemble the vane bracket and the vane with each other.

FIG. 6 shows the vane 81 and vane bracket 82 of a conventional ceiling fan. The vane bracket 82 is formed with three thread holes 821. The vane 81 is formed with three through holes 811 corresponding to the thread holes 821. Bolts 83 are passed through the through holes 811 of the vane 81 and screwed into the thread holes 821 of the vane bracket 82 so as to fix the vane 81 on the vane bracket 82.

The vanes 81 and the vane brackets 82 are separately packed and assembled when installing the ceiling fan. A general ceiling fan has four to seven sets of vanes 81 and vane brackets 82. When assembled, it is necessary to tighten three bolts 83 for assembling each set of vane 81 and vane bracket 82. Accordingly, it is necessary to tighten at least 12~21 bolts 83 for assembling all the vanes 81 and the vane brackets 82. This is a troublesome procedure for a DIY user.

FIGS. 7 and 8 show the vane 91 and vane bracket 92 of another type of conventional ceiling fan. The vane bracket 92 has multiple posts 93. Each post 93 has two upward projecting stop blocks 931. When a stop plate 932 is locked on the post, the stop blocks 931 serve to restrict the stop plate 932. The vane bracket 92 further has a pivot block 94 between the posts 93 for pivotally connecting with an eccentric press lever 95. The vane 91 is formed with slots 911, 912 for the stop plate 932 and eccentric press lever 95 to pass therethrough.

When connecting the vane 91 with the vane bracket 92, the slots 911, 912 of the vane 91 are aimed at the stop plate 932 and eccentric press lever 95 and then fitted onto the vane bracket 92. The stop plate 932 and eccentric press lever 95 extend out of the slots 911, 912. Then the vane 91 is pulled outward to engage the stop plate 932 with top face of the vane 91. Then a washer 96 is fitted under the eccentric press lever 95 and the eccentric press lever 95 is depressed to press the washer 96. At this time, the vane 91 is pressed against and connected with the vane bracket 92.

The above vane 91 and vane bracket 92 have complicated structure and are manufactured at high cost. Moreover, it is troublesome to assemble the vane and vane bracket for a DIY user. In the case that the stop plate 932 and eccentric press lever 95 are previously assembled in the factory, the cost for assembling procedure is increased. Furthermore, the vane 91 is formed with several slots 911, 912 which weaken the strength of the vane 91. Therefore, the vane 91 is liable to break.

SUMMARY OF THE INVENTION

It is therefore a primary object of the present invention to provide an assembling structure for vane and vane bracket of ceiling fan, including a vane bracket and a vane. The vane bracket has several bosses and at least one projecting post. A resilient press board is pivotally disposed on top face of the projecting post. The vane is formed with dents complementary to the bosses of the vane bracket for inserting the bosses into the dents. The vane is further formed with a slot corresponding to the projecting post of the vane bracket. The press board is passed through the slot. The vane is formed with a locating section in which the press section of the press board is located. When connecting the vane bracket with the vane, the press board is rotated to make a press section of the press board resiliently pressed against and located in the locating section of the vane by means of the resilient force of the press board so as to quickly and conveniently fixedly connect the vane bracket with the vane.

The present invention can be best understood through the following description and accompanying drawings wherein:

DETAILED DESCRIPTION OF THE PREFERRED EMBODIMENTS

Figure 1:
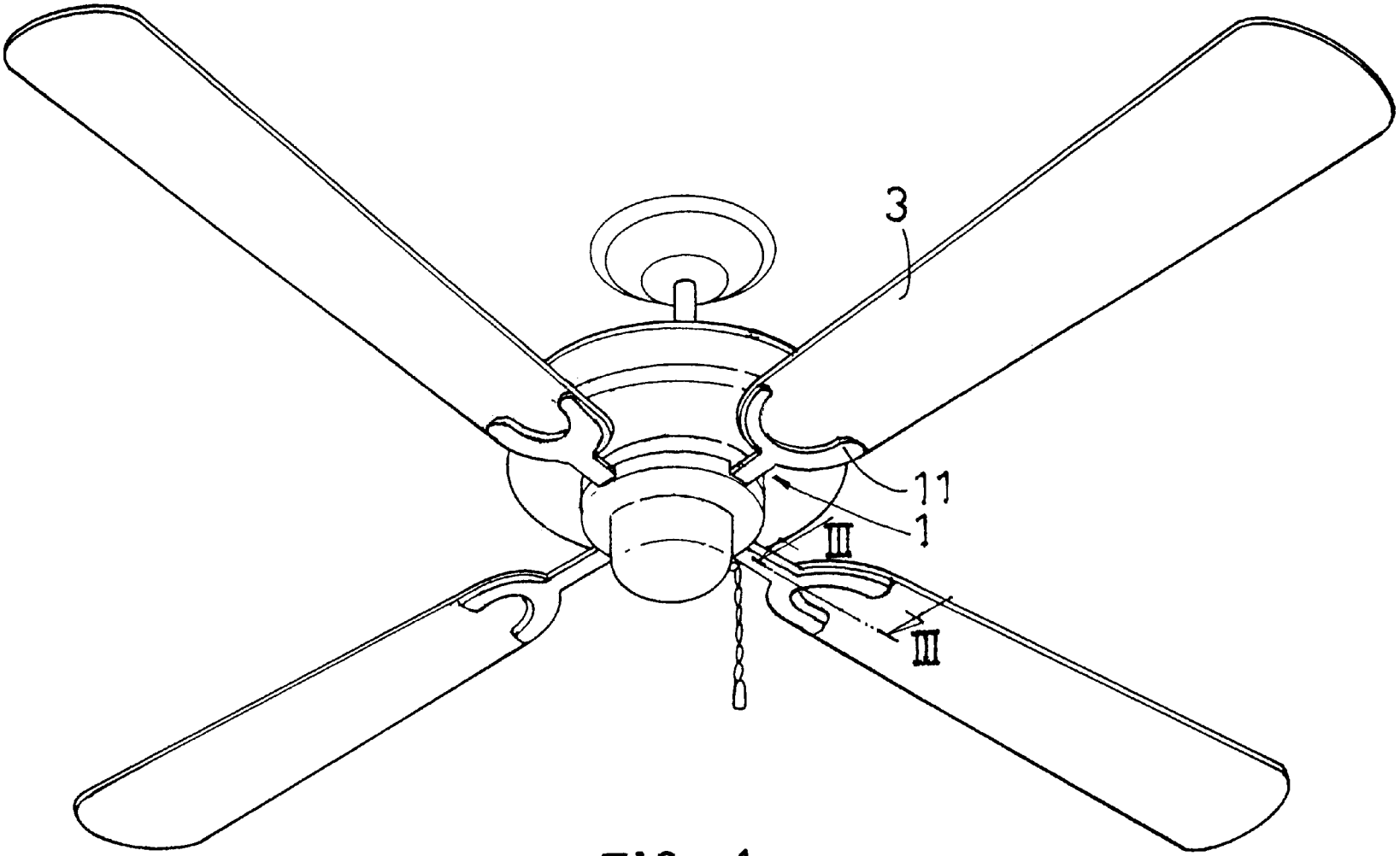
FIG. 1 is a perspective assembled view of the present invention.
Figure 2:
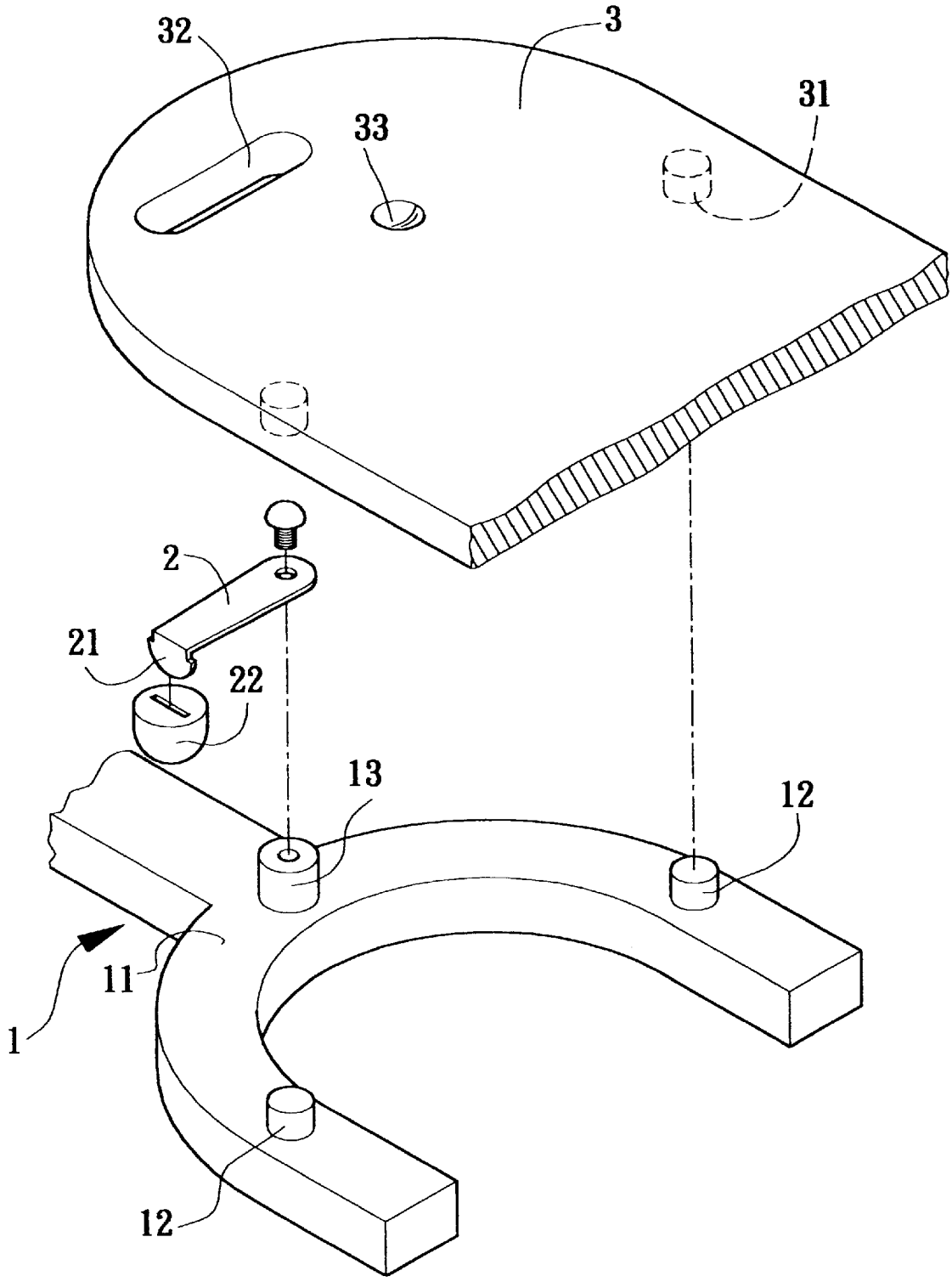
FIG. 2 is a perspective exploded view of the present invention.
Figure 3:
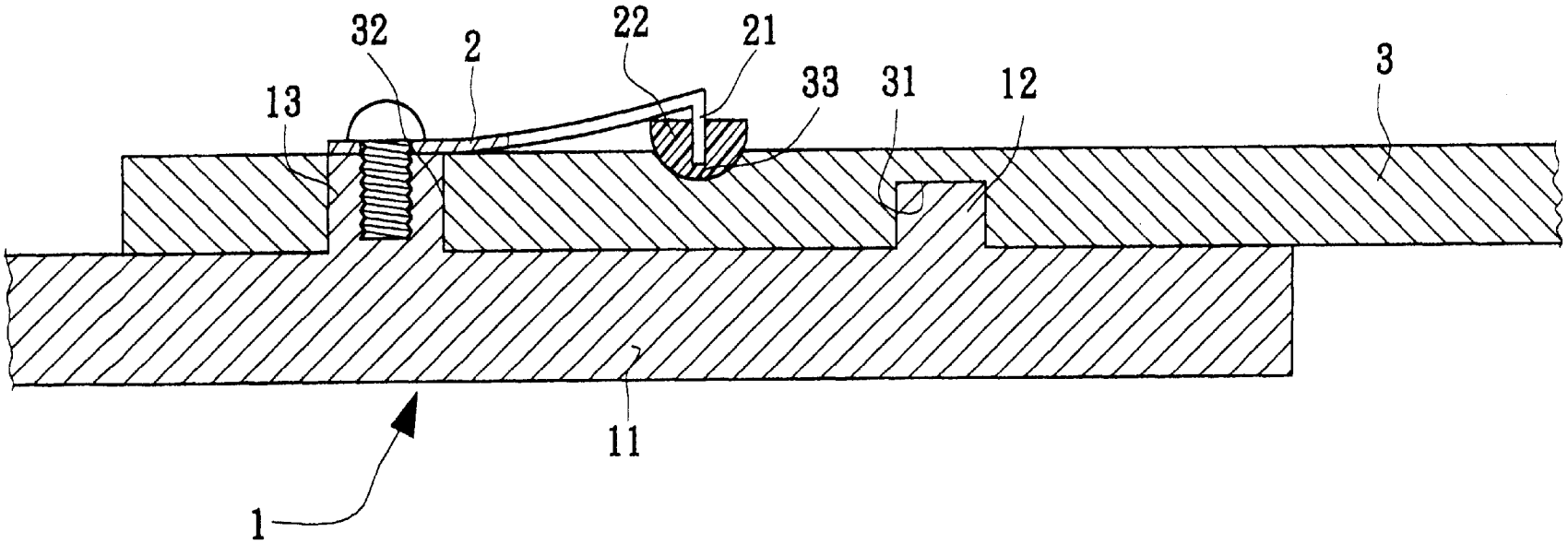
FIG. 3 is a sectional view taken along line III—III of FIG. 1.
Figure 4:
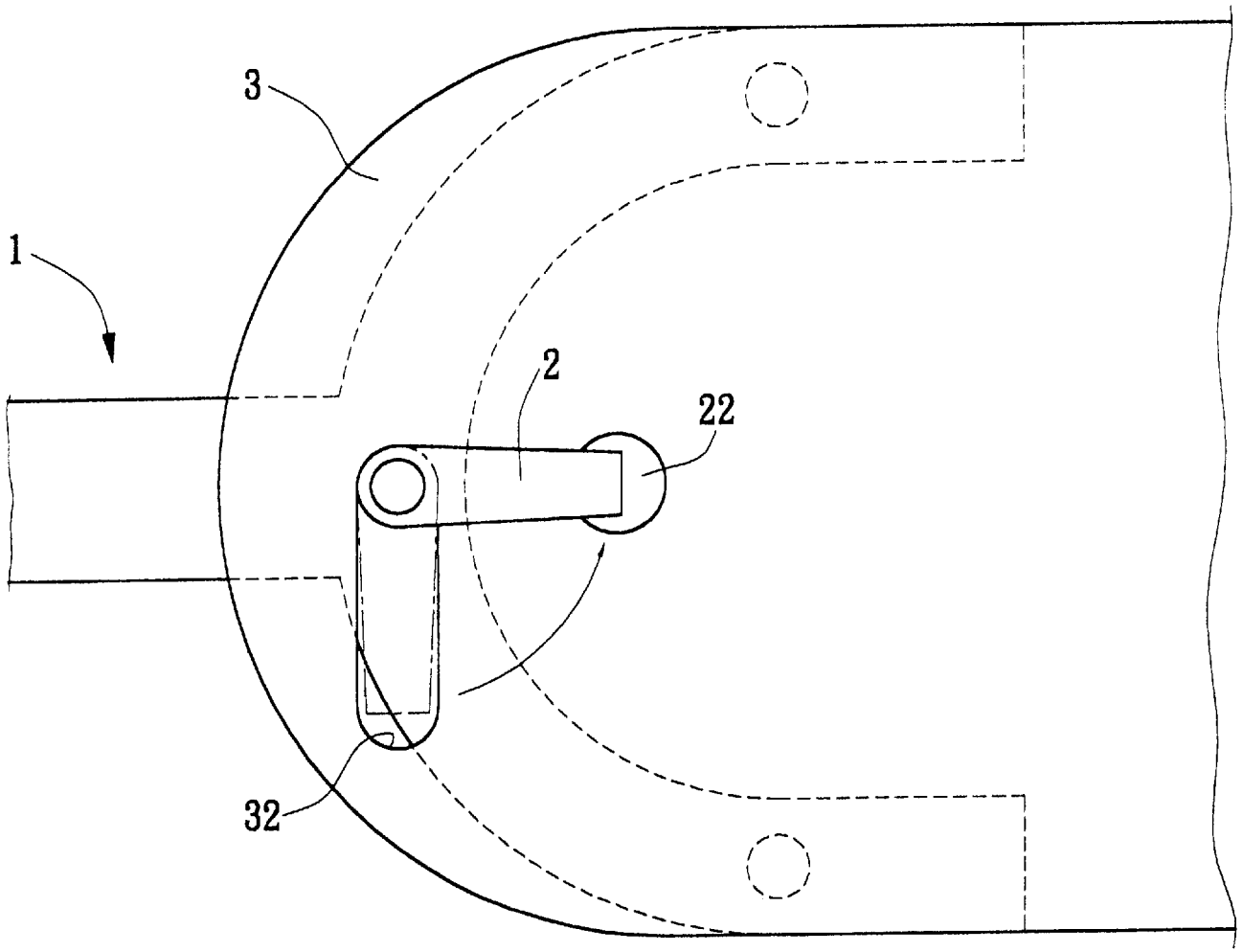
FIG. 4 is a top view showing the assembly of the vane bracket and vane of the present invention.

Please refer to FIGS. 1 to 4. The assembling structure for vane and vane bracket of ceiling fan, including:

a vane bracket 1 having a connecting section 11 which in this embodiment is substantially Y-shaped, each of two ends of the connecting section 11 having a boss 12, a middle portion of the connecting section 11 having a projecting post 13, a resilient press board 2 being pivotally disposed on top face of the projecting post 13, the end of the press board 2 distal from the projecting post 13 having a downward extending vertical section 21, a rubber press block 22 being fitted with the bottom end of the vertical section 21, the rubber press block 22 being a semispherical body; and a vane 3 formed with dents 31 complementary to the bosses 12 of the vane bracket 1 for inlaying the bosses 12 in the dents 31, the vane 3 being formed with a slot 32 corresponding to the projecting post 13 of the vane bracket 1, the press board 2 being passed through the slot 32, the vane 3 being formed with a locating section 33 which is a recess in this embodiment, after the press board 2 is rotated, the press block 22 being located in the locating section 33, the locating section 33 being positioned at an outer end of an extension line defined by the center of the projecting post 13 and the center of the ceiling fan, that is, the locating section 33 being positioned at an outermost position of the rubber press block 22 when the press board 2 suffers a centrifugal force and rotates, when the vane bracket 1 is connected with the vane 3, the press board 2 is rotated to resiliently press the rubber press block 22 against the recess 33 of the vane 3 so as to fix the vane bracket 1 with the vane 3.

When assembled, the press board 2 on the projecting post 13 is first rotated to align the press board 2 with the slot 32 of the vane 3. Then the vane 3 is fitted onto the vane bracket 1 with the bosses 12 of the vane bracket 1 inserted into the dents 31 of the vane 3 and with the projecting post 13 passing through the slot 32. At this time, the press board 2 is extended out of the slot 32 and rotated to press the rubber press block 22 of the vertical section 21 of the press board 2 against the recess 33 of the vane 3. Therefore, the rubber press block 22 is resiliently located in the recess 33 by means of the resilient force of the press board 2 so as to quickly and conveniently fixedly connect the vane bracket 1 with the vane 3 without using any bolt. In addition, the recess 33 is positioned at an outermost position of the rubber press block 22 when the press board 2 suffers a centrifugal force and rotates during rotation of the vane 3 and the vane bracket 1. Therefore, the press board 2 will not be deflected in use so that the vane 1 and the vane bracket 3 are firmly connected with each other. The rubber press block 22 is a semispherical soft body so that it will not scrape the surface of the vane 3 when the vane 3 moves. Moreover, the rubber material helps in tightly pressing the press board 2 against the vane 3.

Figure 5:
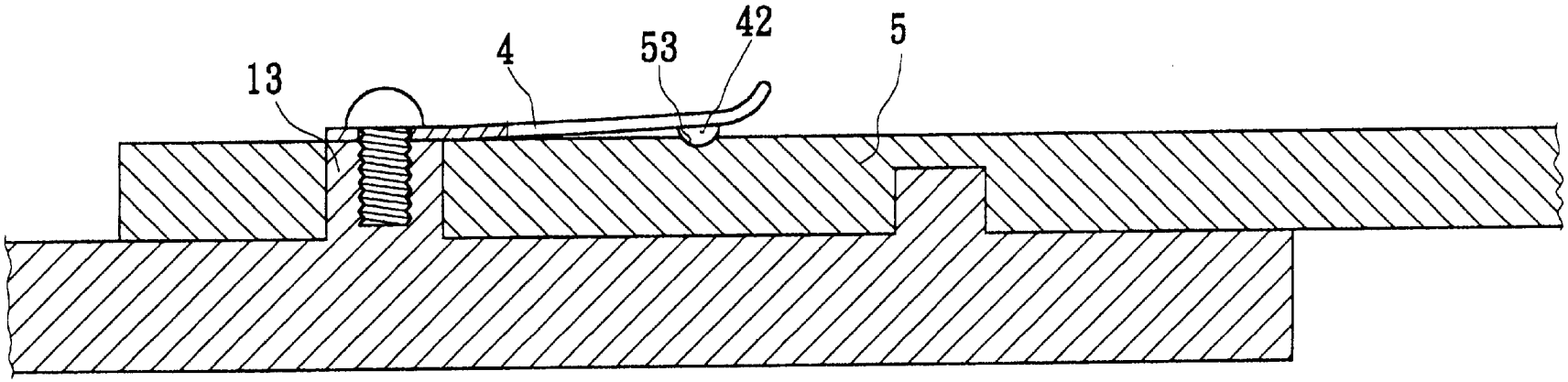
FIG. 5 is a sectional view of a second embodiment of the present invention.
Figure 6:
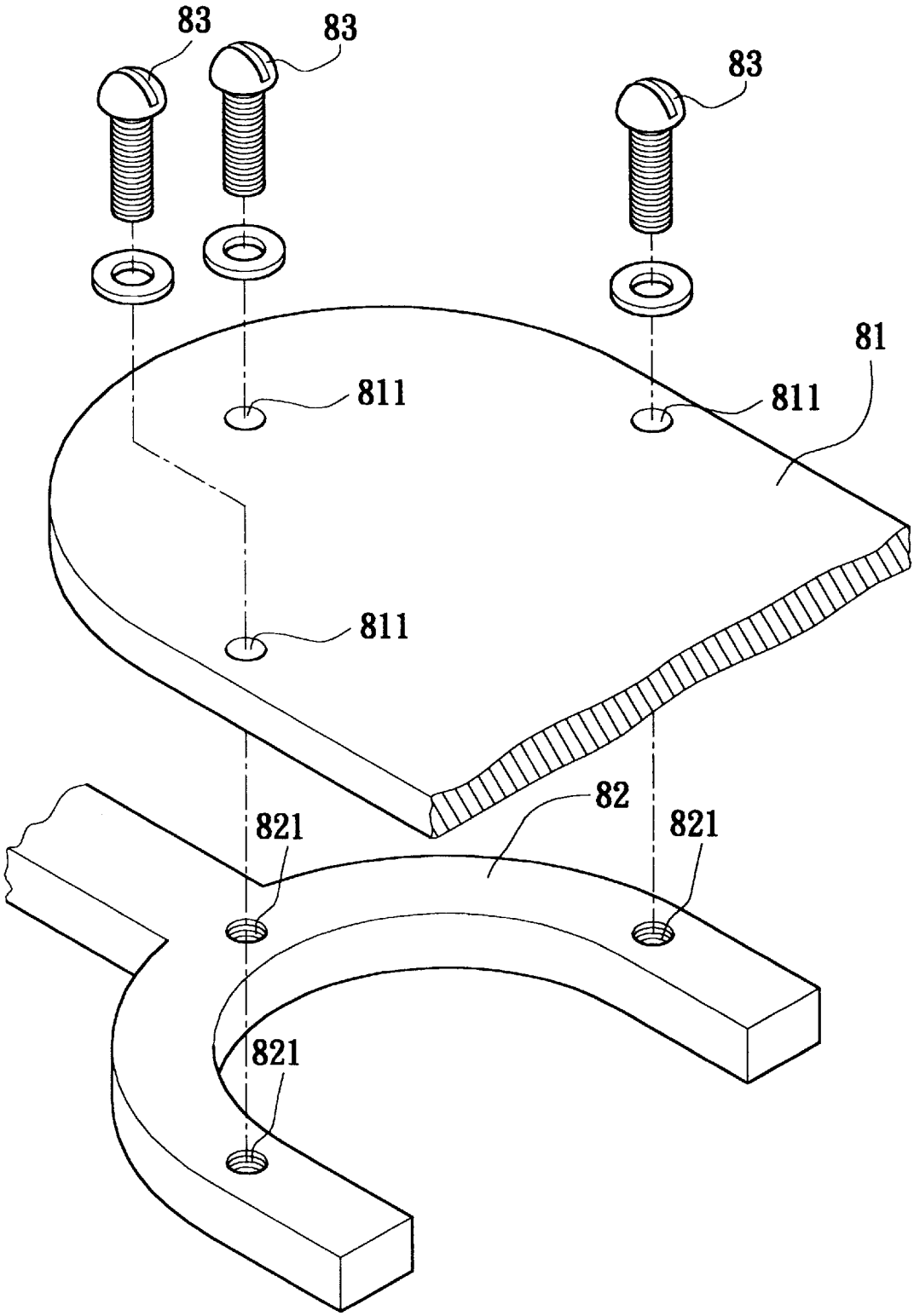
FIG. 6 PRIOR ART
FIG. 6 is a perspective exploded view of a part of the vane and vane bracket of a conventional ceiling fan.
Figure 7:
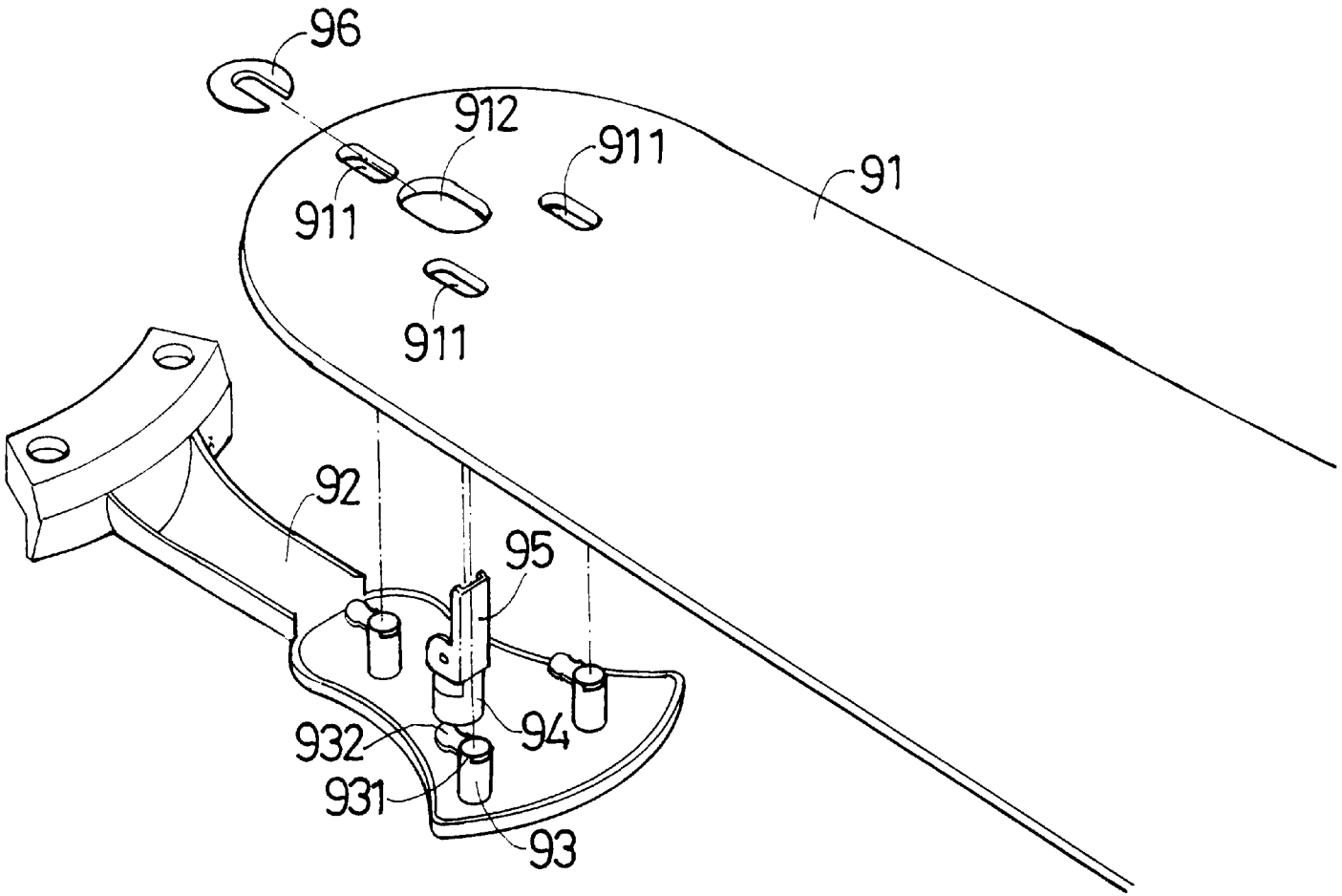
FIG. 7 PRIOR ART
FIG. 7 is a perspective exploded view of the vane and vane bracket of another type of conventional ceiling fan.
Figure 8:
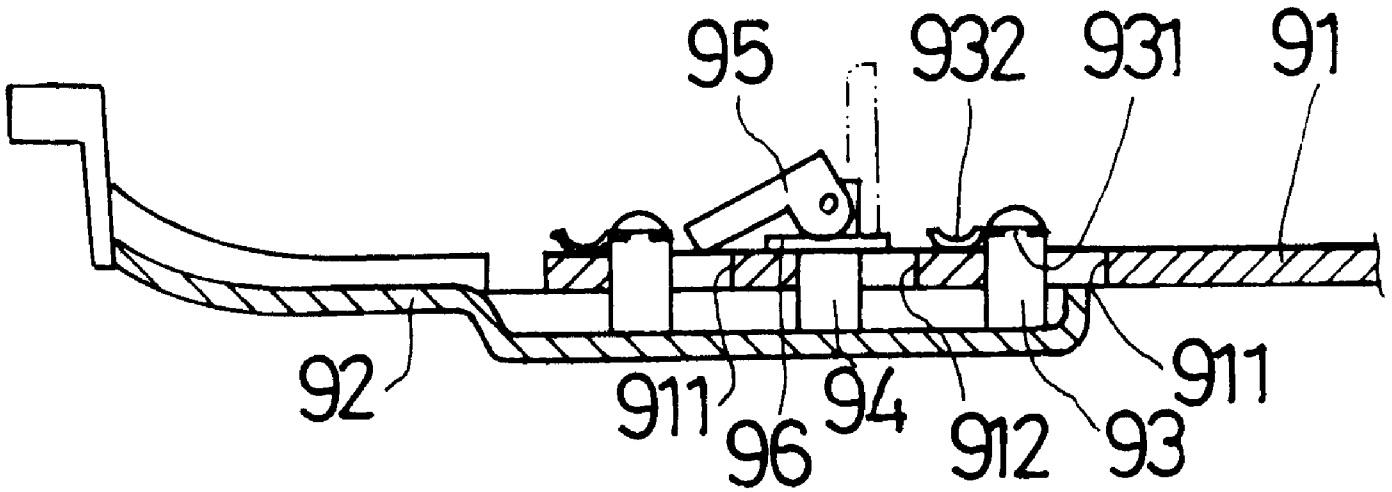
FIG. 8 PRIOR ART
FIG. 8 is a sectional assembled view of the vane and vane bracket of the other type of conventional ceiling fan.

FIG. 5 shows a second embodiment of the present invention, in which the end of the press board 4 distal from the projecting post 13 has a downward projecting press section 42 which is made by punching. The press section 42 is similarly resiliently located in the recess 53 of the vane 5 by means of the resilient force of the press board 4 so as to quickly and conveniently fixedly connect the vane bracket 1 with the vane 5.

The above embodiments are only used to illustrate the present invention, not intended to limit the scope thereof. Many modifications of the above embodiments can be made without departing from the spirit of the present invention.

What is claimed is:

1. An Assembly structure for vanes and vane brackets of ceiling fan, comprising:

a vane bracket having a connecting section having several bosses and at least one projecting post, a resilient press board being pivotally disposed on top face of the projecting post, an end of the press board distal from the projecting post having a downward extending press section; and a vane formed with dents complementary to the bosses of the vane bracket, the vane being further formed with a slot corresponding to the projecting post of the vane bracket, the press board being passed through the slot, the vane being formed with a locating section in which the press section of the press board is located, whereby when connecting the vane bracket with the vane, the press board is rotated to make the press section of the press board resiliently pressed against and located in the locating section of the vane by means of the resilient force of the press board so as to quickly and conveniently fixedly connect the vane bracket with the vane.

2. An Assembly structure for vanes and vane brackets of ceiling fan as claimed in claim 1, wherein the end of the press board distal from the projecting post has a downward extending vertical section, a rubber press block being fitted with a bottom end of the vertical section.

3. An Assembly structure for vanes and vane brackets of ceiling fan as claimed in claim 2, wherein the rubber press block is a semispherical body.

* * * * *